US006235993B1

(12) United States Patent
Johnston et al.

(10) Patent No.: US 6,235,993 B1
(45) Date of Patent: May 22, 2001

(54) CABLE FOR COMPUTED TOMOGRAPHY SYSTEM

(75) Inventors: Brian D. Johnston, Oconomowoc; Thomas R. Murray, Delafield; Paul C. Schanen, Waukesha; Thaddeus R. Ulijasz, Brookfield, all of WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/139,548

(22) Filed: Aug. 25, 1998

(51) Int. Cl.[7] ..... H01B 7/08
(52) U.S. Cl. ..... 174/117 FF
(58) Field of Search ..... 174/36, 117 F, 174/117 FF, 262, 265, 267

(56) References Cited

U.S. PATENT DOCUMENTS 3,612,743 10/1971 Angele et al. ..... 174/106 R
3,612,744 * 10/1971 Thomas ..... 174/117 FF
4,761,517 8/1988 Massit et al. ..... 174/36
5,235,132 * 8/1993 Ainsworth et al. ..... 174/36
5,426,266 * 6/1995 Brown et al. ..... 174/267
5,509,204 * 4/1996 Sadigh-Behzadi ..... 174/117 F X
5,847,324 * 12/1998 Farquhar et al. ..... 174/117 FF

* cited by examiner

*Primary Examiner*—Anthony Dinkins
*Assistant Examiner*—Chau N. Nguyen
(74) *Attorney, Agent, or Firm*—Armstrong Teasdale LLP; Christian G. Cabou

(57) ABSTRACT

A cable for a computed tomography system is described. In one embodiment, the cable electrically connects a detector module to a data acquisition system. The cable includes a conductor layer, an insulating layer and a shield layer having a thermal barrier. The thermal barrier reduces the amount of heat which is transferred from the data acquisition system to the detector module.

17 Claims, 4 Drawing Sheets

CABLE FOR COMPUTED TOMOGRAPHY SYSTEM

FIELD OF THE INVENTION

This invention relates generally to computed tomograph imaging and, more particularly, to a cable for coupling the electrical signals from the x-ray beam detection module to a data acquisition system.

BACKGROUND OF THE INVENTION

In at least some computed tomograph (CT) imaging system configurations, an x-ray source projects a fan-shaped beam which is collimated to lie within an X-Y plane of a Cartesian coordinate system and generally referred to as the "imaging plane". The x-ray beam passes through the object being imaged, such as a patient. The beam, after being attenuated by the object, impinges upon an array of radiation detectors. The intensity of the attenuated beam radiation received at the detector array is dependent upon the attenuation of the x-ray beam by the object. Each detector element of the array produces a separate electrical signal that is a measurement of the beam attenuation at the detector location. The attenuation measurements from all the detectors are acquired separately to produce a transmission profile.

In known third generation CT systems, the x-ray source and the detector array are rotated with a gantry within the imaging plane and around the object to be imaged so that the angle at which the x-ray beam intersects the object constantly changes. X-ray sources typically include x-ray tubes, which emit the x-ray beam at a focal spot. X-ray detectors typically include a collimator for collimating x-ray beams received at the detector, a scintillator adjacent the collimator, and photodiodes adjacent the scintillator.

Multislice CT systems are used to obtain data for an increased number of slices during a scan. Known multislice systems typically include detectors generally known as 3-D detectors. With such 3-D detectors, a plurality of detector elements form separate channels.

Each detector module of the 3-D detector array has several times more output signals than known 1-D detector modules. The high density output lines of 3-D modules typically are placed close to the CT system data acquisition system (DAS) so that the path length loss of the cabling is minimized. A shield is required to minimize the effects of DAS circuitry noise on the detector module low-level output signals. The shield however, provides a thermal path for heat generated by the DAS circuitry to be transferred to the temperature sensitive detector modules. As a result, the accuracy and consistency of the detector modules may be impacted.

Accordingly, it would be desirable to provide a cable that reduces the amount of thermal energy that is transferred from the DAS to the detector modules. It would also be desirable to provide such a cable that maintains the integrity of the shield while remaining flexible.

SUMMARY OF THE INVENTION

These and other objects may be attained by a cable which, in one embodiment, includes a conductor layer for electrically connecting the detector module output lines to a DAS and a shield layer having a thermal barrier. Particularly, the cable includes a shield layer, an insulating material layer and a conductor layer having at least one conductor. The shield layer is placed adjacent to the conductor layer with the insulating material layer fully insulating the shield layer from the conductor layer. The shield layer thermal barrier includes a series of openings that extend diagonally across the shield layer. The thermal barrier openings limit the amount of heat that is transferred through the shield layer without impacting the shielding of the conductor layer. As a result of the thermal barrier, the amount of heat that is transferred from the DAS to the detector module is reduced.

The above described cable enables a large number of high density output lines to be electrically connected from the detector module to the DAS backplane and reduces the amount of heat that is transferred from the DAS to the detector modules. In addition, the above described cable shields the output lines from DAS circuitry noise while remaining flexible.

DETAILED DESCRIPTION

Figure 1:
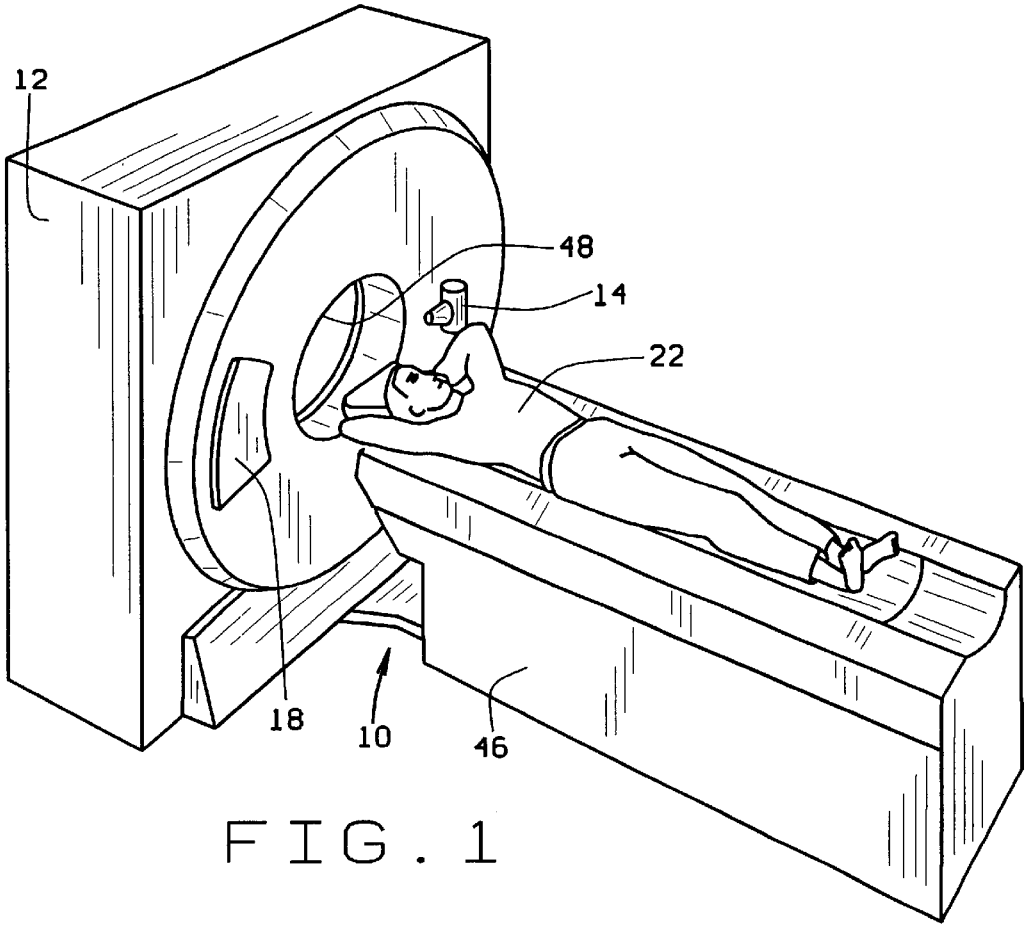
FIG. 1 is a pictorial view of a CT imaging system.
Figure 2:
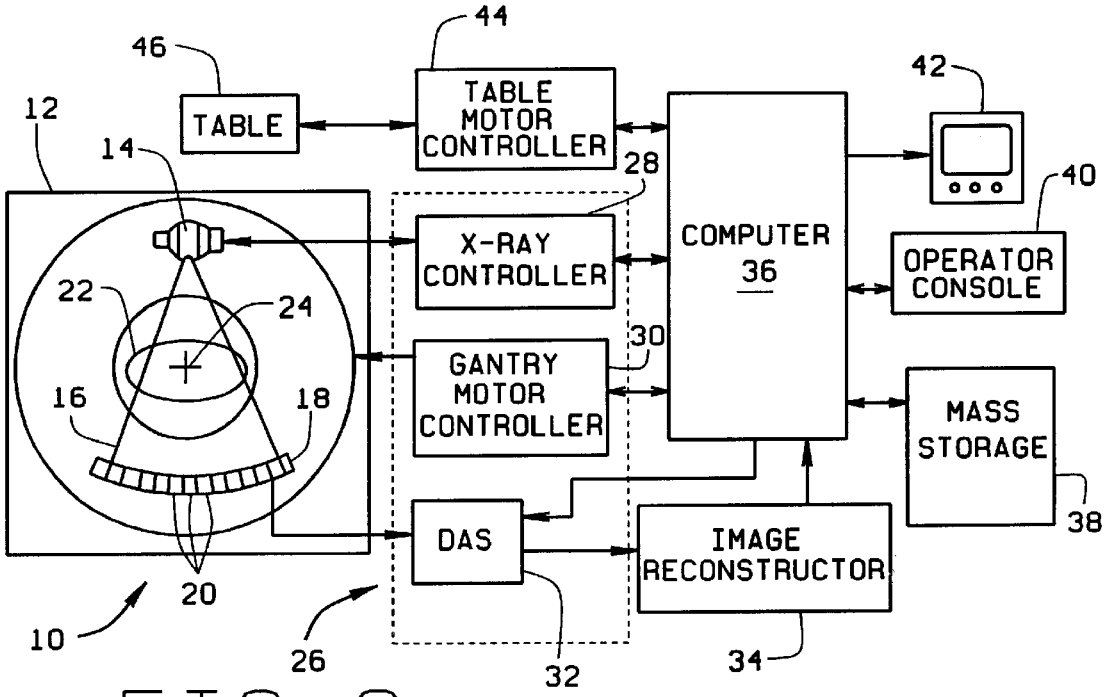
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray source 14 that projects a beam of x-rays 16 toward a detector array 18 on the opposite side of gantry 12. Detector array 18 is formed by detector modules 20 which together sense the projected x-rays that pass through a medical patient 22. Each detector module 20 produces an electrical signal that represents the intensity of an impinging x-ray beam and hence the attenuation of the beam as it passes through patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to x-ray source 14 and a gantry motor controller 30 that controls the rotational speed and position of gantry 12. A data acquisition system (DAS) 32 in control mechanism 26 samples analog data from detector modules 20 and converts the data to digital signals for subsequent processing. An image reconstructor 34 receives sampled and digitized x-ray data from DAS 32 and performs high speed image reconstruction. The reconstructed image is applied as an input to a computer 36 which stores the image in a mass storage device 38.

Computer 36 also receives commands and scanning parameters from an operator via console 40 that has a keyboard. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 36 operates a table motor controller 44 which controls a motorized table 46 to position patient 22 in gantry 12. Particularly, table 46 moves portions of patient 22 through a gantry opening 48.

Figure 3:
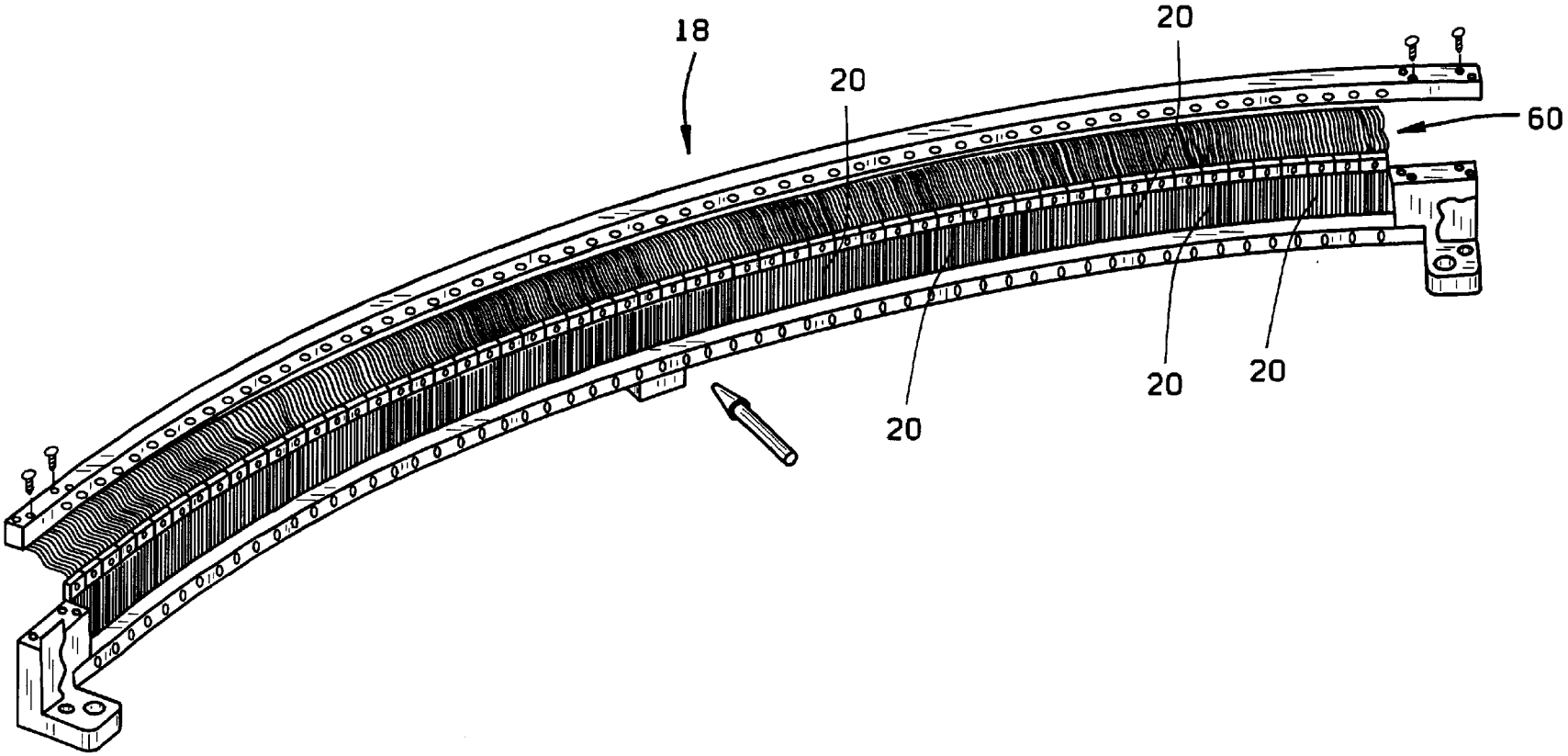
FIG. 3 is a perspective view of a CT system detector array.

As shown in FIG. 3, detector array 18 includes a plurality of detector modules 20. Each detector module is connected to DAS 32 utilizing a flexible electrical cable 60. Particularly, each x-ray detector module includes an array of photodiodes (not shown) with each photodiode producing a separate low level analog output signal that is a measurement of the beam attenuation for a specific location of patient 22.

Figure 4:
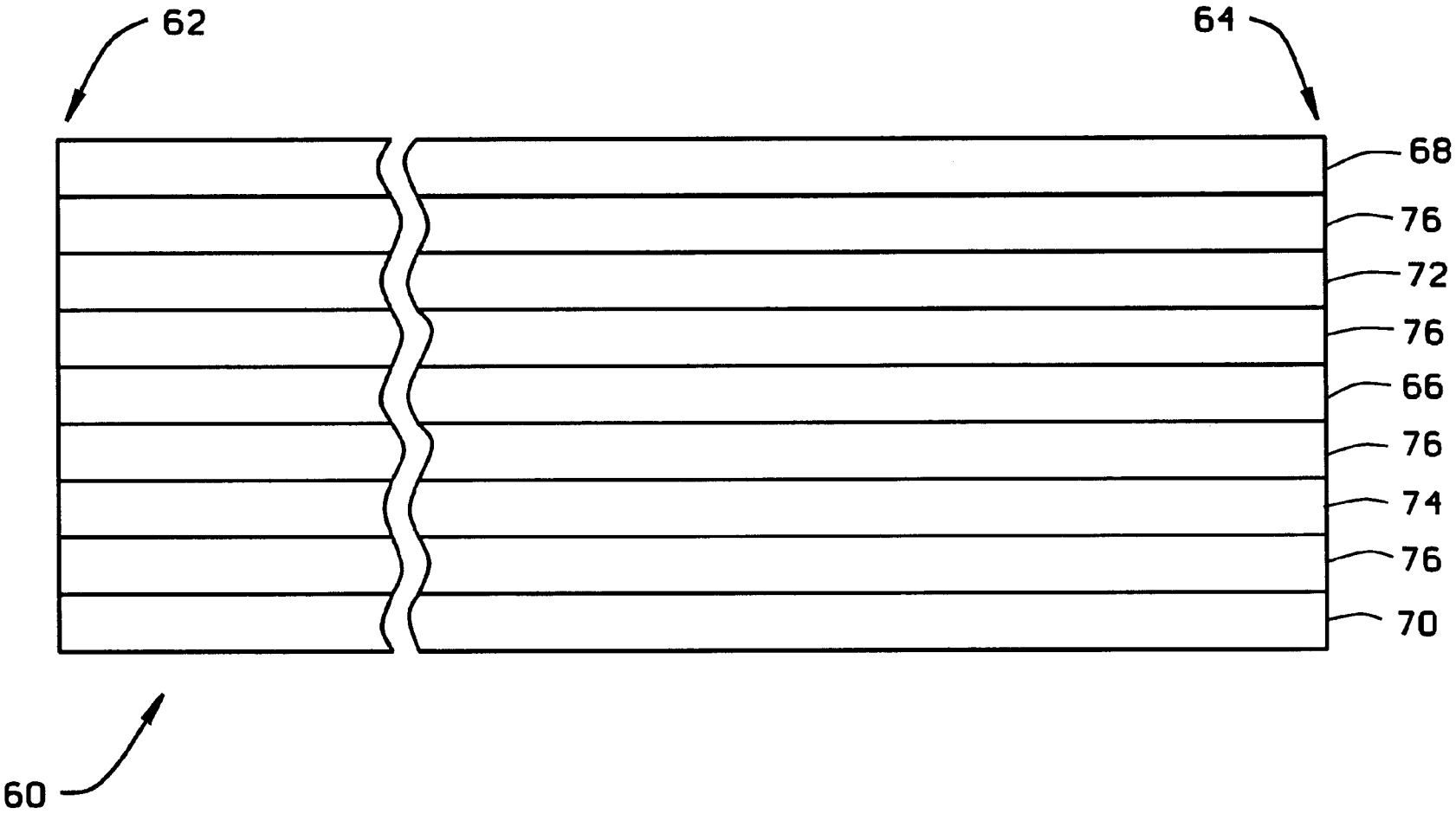
FIG. 4 is a cutaway side view of a cable shown in FIG. 3.

As shown in FIG. 4, flexible electrical cable 60 includes a first end 62, a second end 64 and at least one conductor layer 66 and at least one shield layer 68 extending between first and second ends 62 and 64. Cable 60 may, for example, be a single cable having a single first end (not shown) that connects to multiple detector modules 20 or in an alternative embodiment, may include a cable (not shown) having multiple first ends (not shown) that each connect to one one detector module. Similarly, the cable second ends may include a single second end 64 that connects to DAS 32 or in an alternative embodiment, may include multiple second ends (not shown) that connects to DAS 32.

Figure 6:
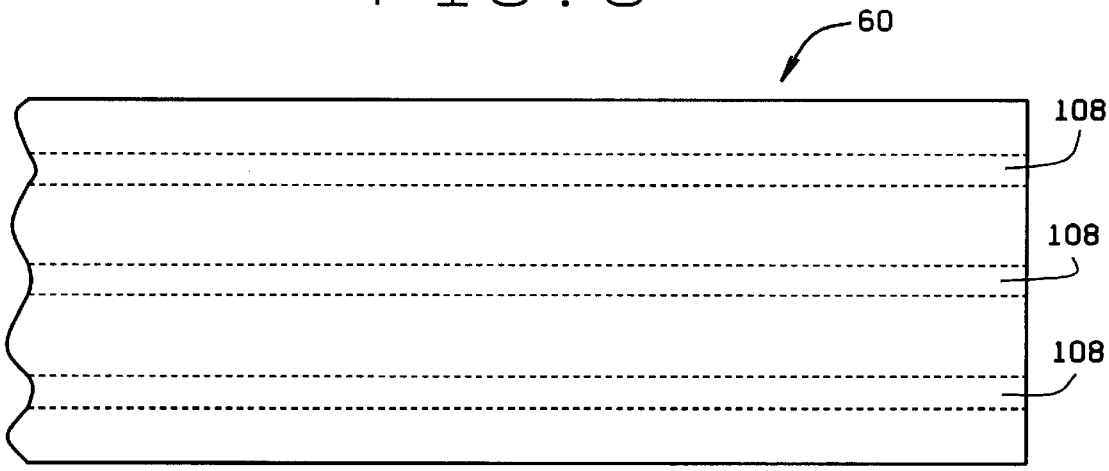
FIG. 6 is a top view of the cable shown in FIG. 3.

In one embodiment and referring to FIG. 4, cable 60 includes conductor layer 66, respective shield layers 68 and 70 and respective insulating layers 72 and 74. To reduce the amount of environmental noise which reaches the detector module low-level output signals, respective shield layers 68 and 70 are placed adjacent to conduct layer 66. Particularly, after bonding or securing respective insulating layer 72 and 74 to conductor layer 66, respective shield layers 68 and 70 are bonded or secured to respective insulating layers 72 and 74. In one embodiment, respective layers 66, 68, 70, 72 and 74 are bonded together using an adhesive 76 as known in the art. Insulating layers 72 and 74 fully insulate respective shield layers 68 and 70 from conductor layer 66. Respective layers 66, 68, 70, 72 and 74 are thin so that cable 60 remains flexible. In one embodiment, conductor layer 66 includes a plurality of conductors that are copper or other conductive material conductors 108 (shown in FIG. 6) and respective insulating material layers 72 and 74 are fabricated from Kapton® or other similar polyimide insulator material.

Figure 5:
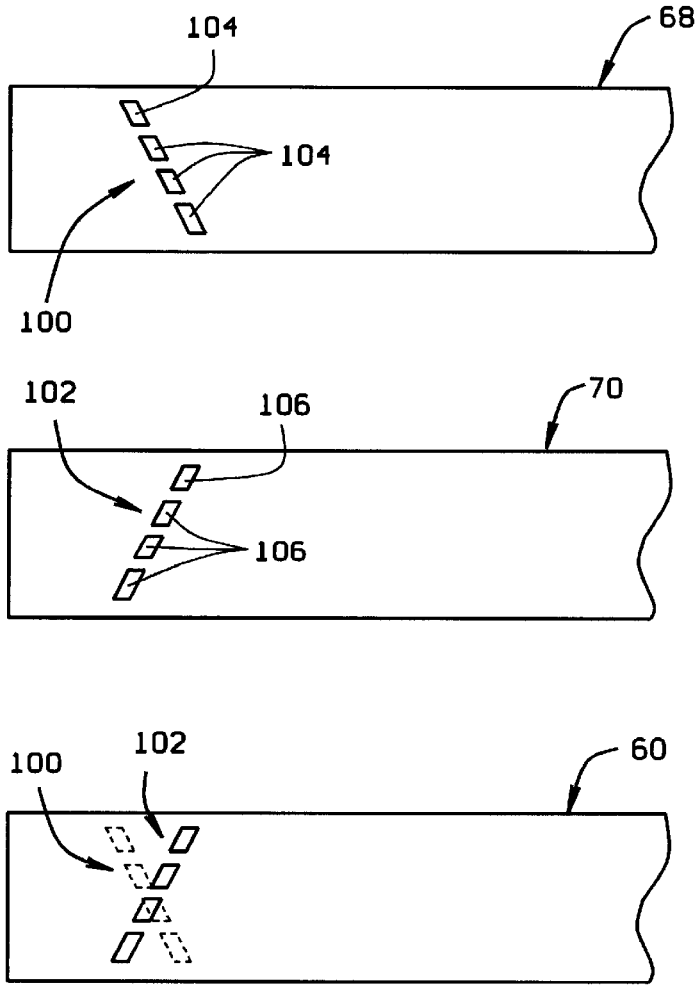
FIG. 5 is a cutaway top view of the cable shown in FIG. 3.

In one embodiment and referring to FIG. 5, shield layers 68 and 70 include respective thermal barriers 100 and 102 to reduce thermal conductivity of cable 60. Referring specifically to shield layer 68, thermal barrier 100 includes at least one opening, or removed area 104 which reduces the cross-sectional area and thermal conductivity of shield layer 68. In one embodiment, to further reduce thermal conductivity, barrier 100 extends diagonally across shield layer 68. Similarly as shown in FIG. 5, thermal break 102 includes at least one opening, or removed area 106 which extends diagonally across shield layer 70. In one embodiment, respective thermal breaks 100 and 102 are canted in opposite directions to maintain the durability and strength of cable 60. Specifically, canting thermal breaks 100 and 102 minimizes overlap of thermal barriers 100 and 102 so that cable 60 is resistant to breakage.

In other alternative embodiments, the size, shape, direction and location of respective thermal barriers 100 and 102 and openings 104 and 106 may be altered. For example, to increase the strength of cable 60, respective barriers 100 and 102 may be positioned so that barriers 100 and 102 do not overlap. In addition to altering the physical characteristics of thermal barriers 100 and 102, cable 60 may include any number of shield layers, insulating layers and conductor layers having any number of conductors.

In use, cable 60 is secured to detector modules 20 and DAS 32. Particularly, cable first end 62 is connected to detector modules 20 so that electrical connections are made to the output lines of the photodiode array via conductor layer 66. Cable second end 64 is connected to DAS 32 so that electrical connections are made to the input lines of a DAS backplane (not shown). Specifically, the electrical connections are made utilizing the conductors of conductor layer 66 in a manner known in the art. For example, the individual conductors of conductor layer 66 may be electrically connected to respective connectors which are secured to DAS 32 and detector modules 20.

During operation of system 10, circuitry within DAS 32 generates environmental, or signal, noise as well as heat. Respective shield layers 68 and 70 shield, or protect the outputs from detector modules 20 from the DAS noise. In addition, respective thermal barriers 100 and 102 reduce the amount of heat generated by DAS 32 that is transferred, or conducted, through respective shield layers 68 and 70. As a result, the temperature sensitive detector modules 20 are subjected to reduced temperature changes.

The above described flexible electrical cable enables the output lines from the detector modules to be electrically connected to the DAS backplane without conducting heat generated by the DAS to the detector modules. The reduced heat transfer reduces changes in the photodiode outputs caused by temperature changes in the detector modules. In addition, the cable shields the output lines from signal noise while remaining flexible.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, the cable may be utilized in any heat sensitive electrical device that requires a shielded cable. Accordingly, the spirit and scope of the invention are to be limited only by the terms of the appended claims.

What is claimed is:

1. A cable for a computed tomography system, the system including at least one detector and a data acquisition system (DAS), said cable comprising:

at least one conductor layer for electrically connecting the detector to the DAS;

a first shield layer adjacent said conductor layer, said first shield layer comprising a first thermal barrier extending diagonally across said first shield layer;

a first insulating layer between said conductor layer and said first shield layer, said layers continuously bonded together from a first end to a second end of said cable;

a second shield layer adjacent said conductor layer on a side opposing said first shield layer; and a second insulating layer between said second shiled layer and said conductor layer;

wherein said second shield layer comprises a second thermal barrier extending diagonally across said second shield layer and said first and second thermal barriers are canted in opposite directions.

2. A cable in accordance with claim 1 wherein said conductor layer comprises a plurality of conductors configured to electrically connect the detector to the DAS.

3. A cable in accordance with claim 2 wherein said conductors are copper.

4. A cable in accordance with claim 1 wherein said first and second shield layers are copper.

5. A cable in accordance with claim 1 wherein the at least one conductor layer comprises a plurality of conductor layers.

6. A cable in accordance with claim 1 wherein said first and second shield layers are solid and said first thermal barrier comprises a plurality of openings in said first shield layer, said plurality of openings extending in a row diagonally across said first shield layer, said second thermal barrier comprising a plurality of openings in said second shield layer, said plurality of opening extending in a row diagonally across said second shield layer.

7. A computed tomography system comprising:

at least one detector;

a data acquisition system (DAS); and a cable for electrically coupling said detector to said DAS, said cable comprising at least one conductor layer, a first shield layer adjacent to said at least one conductor layer having a first thermal barrier extending diagonally across said first shield layer and a first insulating layer between said conductor layer and said first shield layer, said layers continuously bonded together from a first end to a second end of said cable;

said cable further comprising a second shielded layer adjacent said conductor layer on a side opposing said first shield layer, and a second insulating layer between said second shield layer and said conductor layer;

wherein said second shield layer comprises a second thermal barrier extending diagonally across said second shield layer and said first and second thermal barriers are canted in opposite directions.

8. A system in accordance with claim 7 wherein said conductor layer comprises a plurality of conductors configured to electrically connect said detector to said DAS.

9. A system in accordance with claim 8 wherein said conductors are copper.

10. A system in accordance with claim 7 wherein said first and second shield layers are copper.

11. A system in accordance with claim 7 wherein the at least one conductor layer comprised a plurality of conductor layers.

12. A system in accordance with claim 7 wherein said first and second shield layers are solid and said first thermal barrier comprises a plurality of openings in said first shield layer, said plurality of openings extending in a row diagonally across said first shield layer, said second thermal barrier comprising a plurality of openings in said second shield layer, said plurality of opening extending in a row diagonally across said second shield layer.

13. A cable comprising:

at least one conductor layer;

a first shield layer adjacent said conductor layer, said first shield layer comprising a first thermal barrier extending diagonally across said first shield layer;

a first insulating layer between said conductor layer and said first shield layer, said layers continuously bonded together from a first end to a second end of said cable;

a second shield layer adjacent said conductor layer on a side apposite said first shield layer; and a second insulating layer between said second shield layer and said conductor layer;

wherein said second shield layer comprises a second thermal barrier extending diagonally across said second shield layer and said first and second thermal barriers are canted in opposite directons.

14. A cable in accordance with claim 13 wherein said cable is flexible.

15. A cable in accordance with claim 13 wherein the at least one conductor layer comprises a plurality of conductor layers.

16. A cable in accordance with claim 13 wherein said first and second shield layers are solid and said first thermal barrier comprises a plurality of openings in said first shield layer, said plurality of openings extending in a row diagonally across said first shield layer, said second thermal barrier comprising a plurality of openings in said second shield layer, said plurality of opening extending in a row diagonally across said second shield layer.

17. A cable for a computed tomography system, the system including at least one detector and a data acquisition system (DAS), said cable comprising:

a conductor layer for electrically connecting the detector to the DAS;

a first solid shield layer adjacent said conductor layer, said first solid shield layer comprising a first thermal barrier, said first thermal barrier comprising a plurality of openings in said first solid shield layer, said plurality of openings extending in a row diagonally across said first solid shield layer;

a first insulating layer between said conductor layer and said first shield layer, said layers continuously bonded together from a first end to a second end of said cable;

a second solid shield layer adjacent said conductor layer on a side opposing said first shield layer, said second solid shield layer comprising a second thermal barrier, said second thermal barrier comprising a plurality of openings in said second solid shield layer, said plurality of openings extending in a row diagonally across said second solid shield layer; and a second insulating layer between said second shield layer and said conductor layer;

wherein said first and second thermal barriers are canted in opposite directions.

* * * * *

UNITED STATES PATENT AND TRADEMARK OFFICE

CERTIFICATE OF CORRECTION

PATENT NO. : 6,235,993 B1
DATED : May 22, 2001
INVENTOR(S) : Johnston et al.

It is certified that error appears in the above-identified patent and that said Letters Patent is hereby corrected as shown below:

Column 4,
Line 50, delete "shiled" and insert therefor -- shield --.

Column 5,
Line 43, delete "opening" and insert therefor -- openings --.

Column 6,
Line 2, delete "apposite" and insert therefor -- opposite --.
Line 22, delete "opening" and insert therefor -- openings --.

Signed and Sealed this

Seventh Day of May, 2002

*Attest:*

*Attesting Officer*

JAMES E. ROGAN
*Director of the United States Patent and Trademark Office*